US005148561A

United States Patent [19]

Tharalson et al.

[11] Patent Number: 5,148,561

[45] Date of Patent: Sep. 22, 1992

[54] BABY CRIB ADJACENT TO PARENTAL BED

[76] Inventors: Douglas E. Tharalson; Diana M. Tharalson, both of 29995 Mulholland Hwy., Agoura, Calif.

[21] Appl. No.: 852,298

[22] Filed: Mar. 16, 1992

[51] Int. Cl.[5] ..... A47D 7/00; A47D 7/04

[52] U.S. Cl. ..... 5/95; 5/99.1

[58] Field of Search ..... 5/93.1, 99, 95, 96, 5/99.1, 185, 421, 424, 426, 503.1, 658

[56] References Cited

U.S. PATENT DOCUMENTS

| | | | |
|---|---|---|---|
| 413,107 | 10/1889 | Stoy | 5/95 |
| 620,067 | 2/1899 | Cobb | 5/95 |
| 1,135,523 | 4/1915 | Henderson | 5/658 X |
| 2,475,775 | 7/1949 | Boren | 5/93.1 |
| 3,400,829 | 9/1968 | Youngson | 5/93.1 X |
| 3,840,924 | 10/1974 | Hamilton | 5/503.1 X |
| 3,854,156 | 12/1974 | Williams | 5/421 |
| 3,856,276 | 6/1971 | O'Mahoney | 5/503.1 X |
| 4,123,809 | 11/1978 | Pugh | 5/420 X |

FOREIGN PATENT DOCUMENTS 102172 11/1916 United Kingdom ..... 5/95

*Primary Examiner*—Michael F. Trettel

*Attorney, Agent, or Firm*—Cislo & Thomas

[57] ABSTRACT

A baby crib for use adjacent parent's bed for new born children comprising easily assembled and disassembled components which can be easily stored and shipped. The crib comprises a first horizontal panel having a perpendicularly positioned vertical wall curving around the first horizontal panel on three sides. The first horizontal panel can be hingedly mounted with a second horizontal panel in conjunction with horizontal supports so that the second horizontal panel and a portion of the first horizontal panel may be slid in between a standard box spring and a mattress of a parent's bed. Also, an adjustable vertical support can be utilized to keep the adjacent crib stable and to retain therein a baby mattress, and also provide for various types of clip-on attachments to retain baby accessories and illuminate the baby crib.

14 Claims, 3 Drawing Sheets

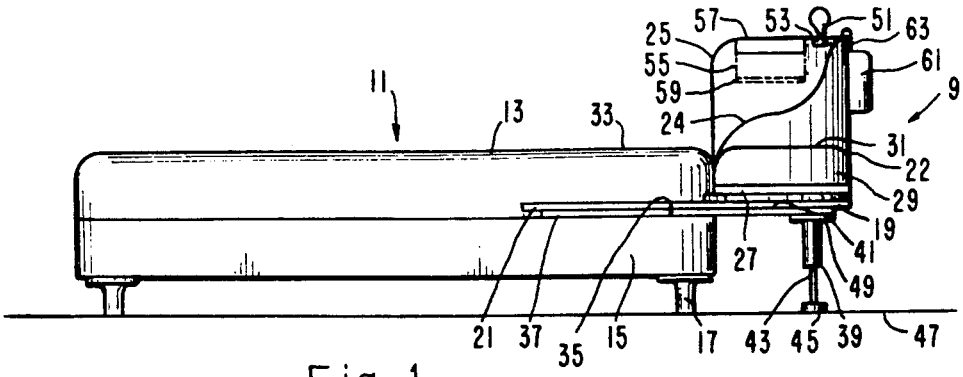
Fig. 1.
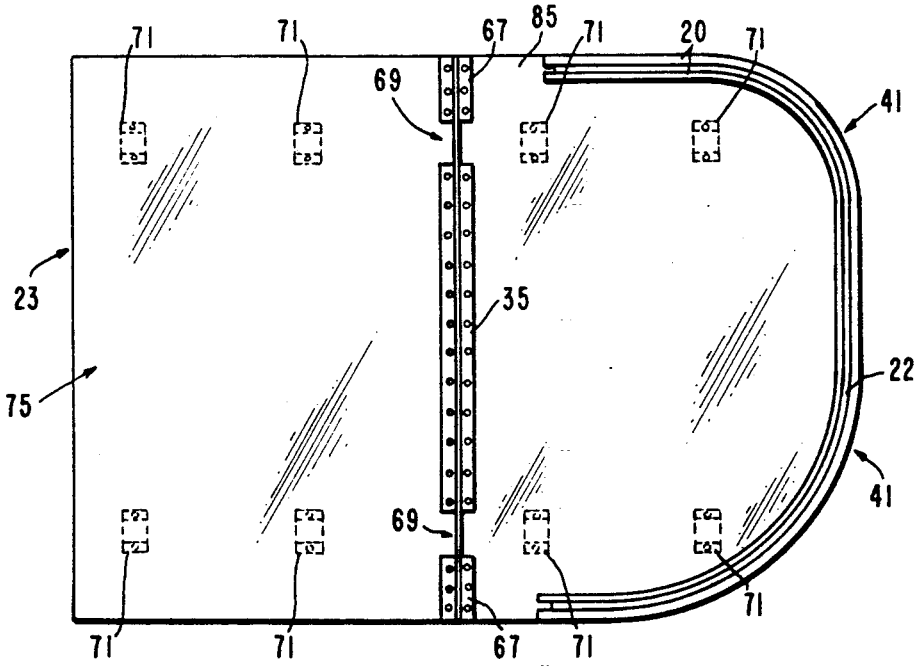
Fig. 2.
Fig. 3.
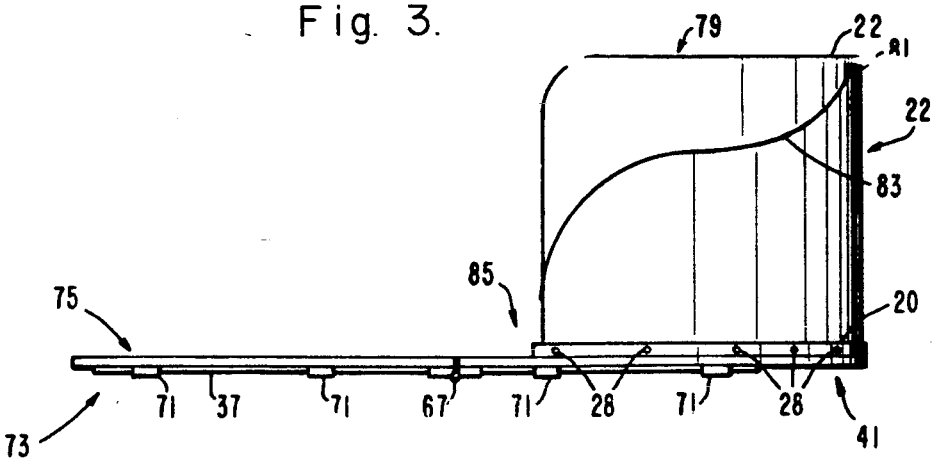

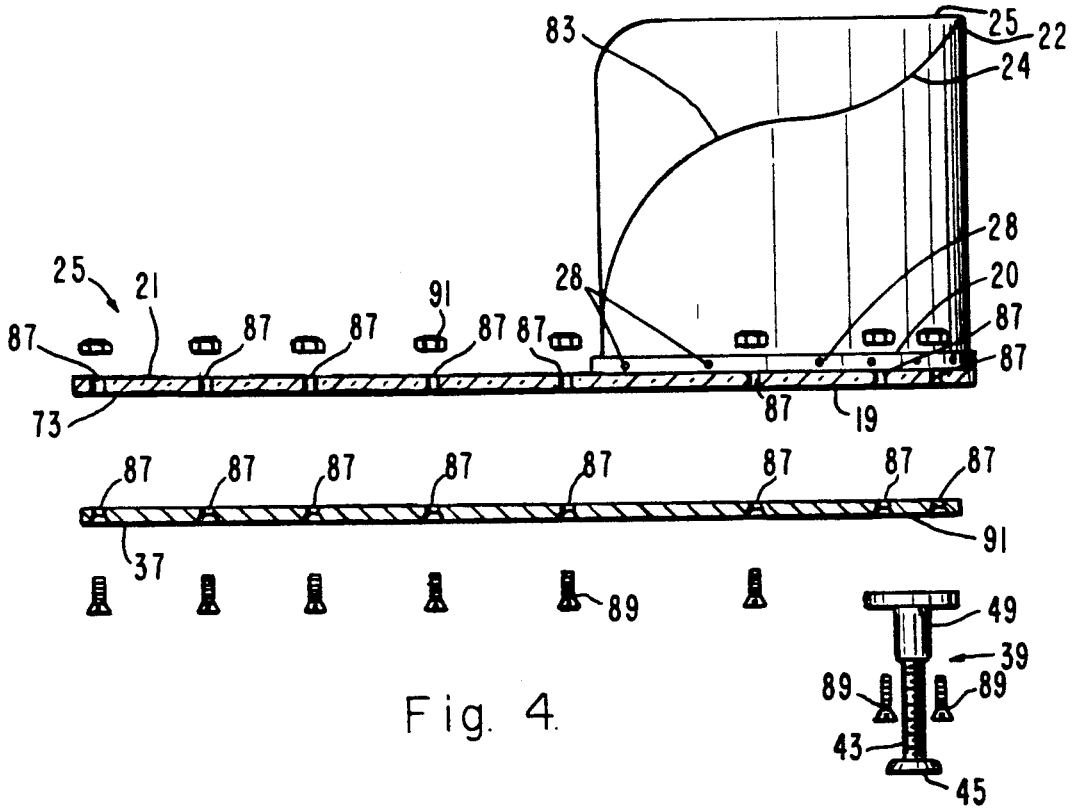
Fig. 4.
Fig. 5.
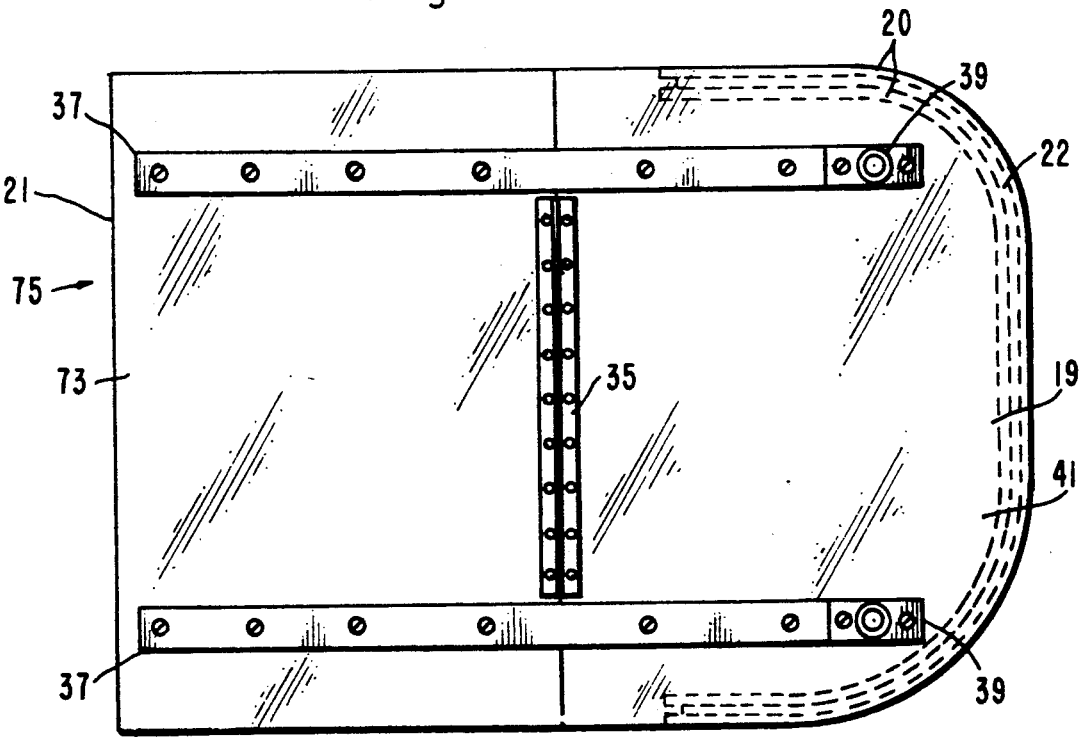

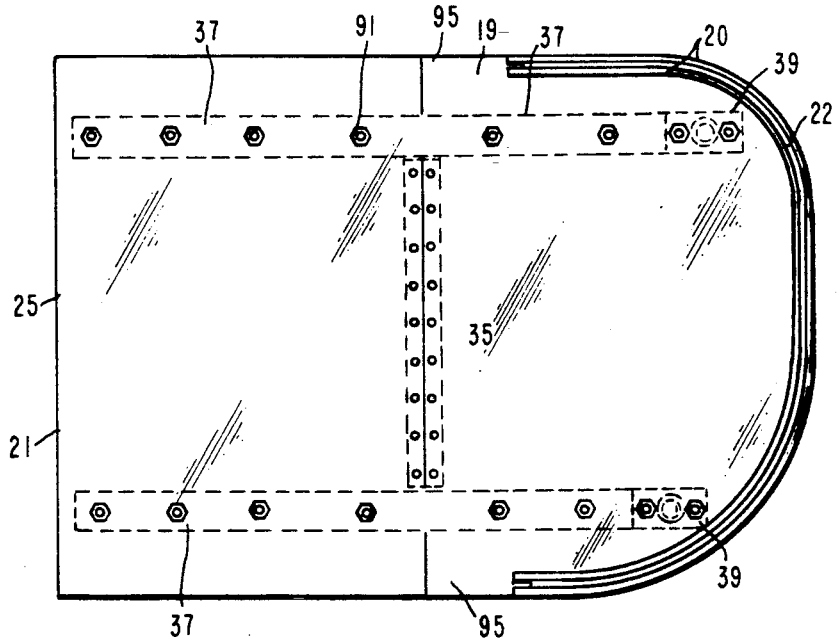
Fig. 6.
Fig. 7.
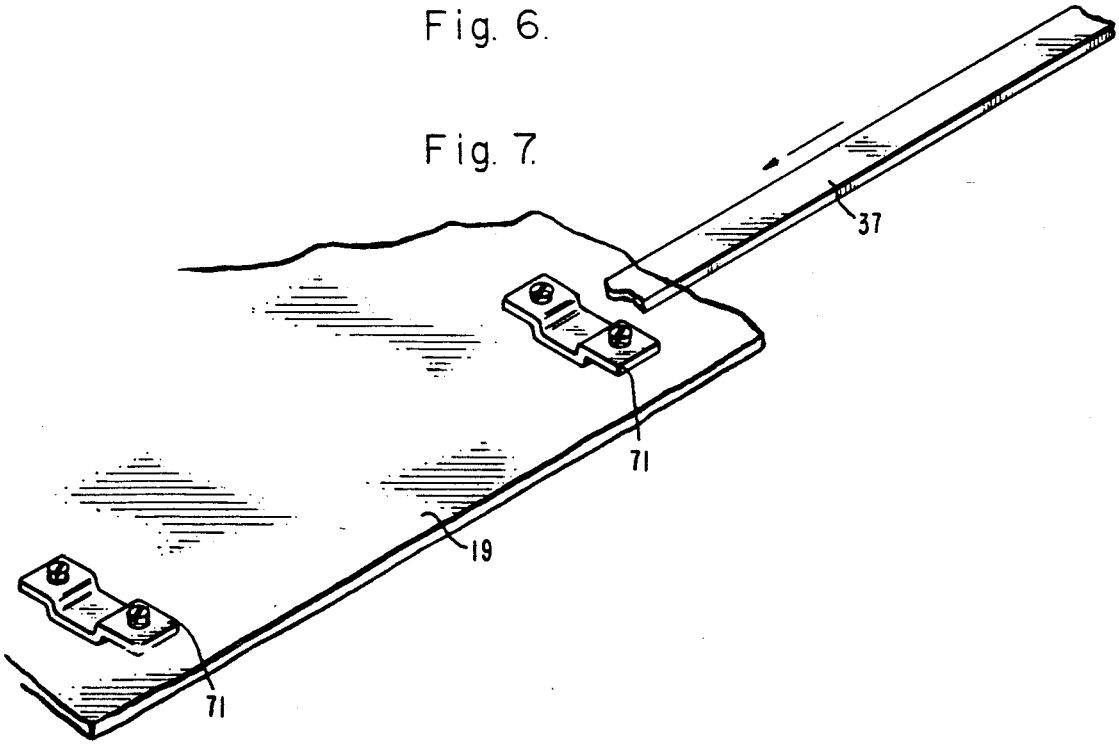

BABY CRIB ADJACENT TO PARENTAL BED

BACKGROUND OF THE INVENTION

This invention relates generally to baby cribs, and more particularly to baby cribs that can be positioned adjacent to a parent's bed for easy access to the baby for feeding, comforting, and changing diapers, but more importantly early child-parent bonding.

There are a large number of different types of children's beds shown in the prior art. Many of the baby cribs are constructed and are of a type that can be positioned close to or attached to a parent's bed. A preliminary patentability search conducted at the Patent and Trademark Office directed to a field of search encompassing classes 5/93.1, 94, 95, 96, and 426 revealed a number of existing patents generally showing small beds or cots adjacent to a mother's bed:

| Patent No. | Inventor | Issue Date |
|---|---|---|
| 542,759 | D. Froehlich | July 16, 1895 |
| 814,538 | W. W. Grigsby | Mar. 6, 1906 |
| 961,669 | H. A. Atkinson | June 14, 1910 |
| 1,138,451 | H. H. Bugele | May 4, 1915 |
| 1,171,029 | F. Dutour | Feb. 8, 1916 |
| 1,200,830 | S. F. Goss | Oct. 10, 1916 |
| 1,267,244 | C. A. McMillan | May 21, 1918 |
| 1,495,988 | P. Catino | June 3, 1924 |
| 2,763,014 | K. E. Luger | Sept. 18, 1956 |
| 3,402,409 | A. F. Kain | Sept. 24, 1968 |
| 3,482,810 | W. C. Bailey | Dec. 9, 1969 |
| 4,726,083 | V. S. Hoshall | Feb. 23, 1988 |

The more pertinent patents are described in greater detail below:

The Dutour U.S. Pat. No. 1,171,029 invention is directed to a folding cot for babies or small children. A folding cot-like structure is cantilevered from the L-shaped side supports of the bed, as opposed to passing between the box spring and mattress. The crib-like structure is clamped to the side members by means of an L-member having an integral hook and a thumb screw. The detachable cot provides means by which the mother can easily access the child, while providing a place for the child to sleep apart from the mother's bed.

The Kain U.S. Pat. No. 3,402,409 invention is directed to a guard device for preventing small children from falling out of bed. Here the means by which the guard is secured to the bed comprises panel members, which may be formed of plastic, and coupled to the bed by means of inserting panel between the mattress and box spring portion for supporting the panel which is coupled to panel by a plurality of prongs which interface with the slots formed in panel.

The Bailey U.S. Pat. No. 3,482,810 invention is directed to a bedside holder for tissues. A means by which the tissue box or, alternately housing or frame is coupled to the bed. A holder is disposed between the standard mattress and box spring, thereby maintaining an accessory in close proximity to the person lying in bed.

The Bugele U.S. Pat. No. 1,138,451 invention is directed to a baby crib attachable to the side of a bed. The crib is formed by a plurality of panels hingedly coupled one to another to allow for folding. Further, the crib structure is coupled to the bed frame by means of a plurality of straps having buckles.

The Grigsby U.S. Pat. No. 814,538 invention is directed to a crib which is reversibly attachable to a bed. The wireform crib includes a pair of hooking devices, each having an extended portion which fits under a bedstead-mattress.

The Hoshall U.S. Pat. No. 4,726,083 invention is directed to a system for preventing a mattress from slipping relative to a box spring. A conventional box spring is provided with a hook portion of a hook-and-pile (loop) fastening system, while the mattress includes the pile portion positionally located for interface with the hook portion when the mattress is properly disposed upon the box spring, preventing relative sliding therebetween.

There is potential interest in the crib industry, to have available a compact, easy to clean, lightweight, portable, sturdy and easily manufacturable adjacent baby crib which can be durable enough to support a child, safe in its utilization, and offer a greater ease of accessibility to a newborn child. Unlike many of the prior art cots, there is a strong interest in having a standard piece of furniture which allows for greater child bonding.

The features identified above as being desirable for adjacent baby cribs are all provided by the present invention.

SUMMARY OF THE INVENTION

The crib of the present invention comprises an assembly having peripheral vertical walls attachable to a bottom panel which can extend between a box spring and a mattress for stability. The crib has a higher wall on at least one portion which gradually tapers to a lower end so as not to interfere with the mother getting in and out of bed. The walls of the crib can be a "see-through" polymer or acrylic material, and a separate stabilizing means can be used which fits under a mattress, and possibly between a mattress and a box spring.

The stabilizing means and the crib can be detachably attached together for compactness and portability. The general idea of the invention is to provide quick access to a baby for nursing, comforting and changing without requiring the mother to get in and out of bed, and yet provide for a separate baby area apart from the parent's bed.

Particularly, the invention comprises a baby crib or the like in association with the mattress of the bed comprising primarily a first horizontal panel for supporting a crib mattress. The vertical wall partially encircles the first horizontal panel, and is insertable within and attachable to rails or a slotted channel upon the first horizontal panel.

A second horizontal panel supporting the first horizontal panel means is for stability. The second horizontal panel is attached to the first horizontal panel means. The second horizontal panel is positionable under the mattress to provide greater structural support to the first horizontal panel. As a result of this configuration, the second horizontal panel supports the first horizontal panel against the flexural load of the baby mattress and baby placed upon the first horizontal means.

The vertical wall of the baby crib can be removable from the rails or slotted channel of the first horizontal panel and flattened so as to provide for a more compact baby crib for storage or transportation in a disassembled condition.

At least one horizontal support can be used which is attachable to an underside of both horizontal panel. In fact, a plurality of these horizontal supports can be used to provide additional structural support between both horizontal panels while maintaining the baby crib in an extended condition.

The baby crib can include a vertical support attachable to an undersurface of the first horizontal panel so as to support the first horizontal panel, the attached vertical wall, mattress and baby when the crib is in an extended condition. The vertical support is of length sufficient to extend between the extended first horizontal panel and the floor supporting the bed. Also, the vertical support can be of the type having a variable length which can be extended depended upon the application, the bed and the distance between the placement of the second horizontal panel and the floor.

The vertical wall of the crib has a varying height along its length or its periphery. This allows for a greater ease of access to the crib from one or both sides of the crib, preferably at least one side closest to the foot of the bed. Therefore, it is easier for a parent to reach into the crib and comfort the baby or to pick up the baby from the foot of the bed area. The vertical wall can be opaque or transparent for purposes of allowing the baby to see out of the crib or the parent to easily see into the crib without looking over the top of the crib. The vertical wall can be screwedly fastened to the rails or within the slotted channel of the first horizontal panel, or otherwise affixed.

In the more detailed aspects of the invention, the first horizontal panel can be attached to the second horizontal panel by way of a hinge which allows the first and second panels to rotate relative to each other. This folding concept allows for a greater compactness for ease of storage or transportation when the crib is not in use.

In still other detailed aspects of the invention, the horizontal supports can be screwedly affixed to the first and second horizontal means. Alternatively, both horizontal panels can have loops or attachments for purposes of easily sliding in or sliding out the horizontal supports. These horizontal supports can be positioned relative to the hinge, or a plurality of hinges which connect both horizontal panels in a manner so as not to interrupt the hinges' operation. The horizontal supports lie generally in the same horizontal plane as the hinges.

The baby crib can also accommodate numerous clip-on accessories for holding baby accessories utilizing a basket, a shelf, a travel rack, a bottle holder or other configuration. Also, a night light and sound producing device may be clipped onto the vertical wall of the baby crib.

Finally, a mattress can be used of a shape and size so as to fit within the vertical wall of the crib and upon the first horizontal panel. The mattress can have an interior region of soft material which can be heated, thereby creating a soft and warm environment for a baby. A washable waterproof material can be used to surround the mattress to protect the soft material from baby spills or wetting. An outer mattress cover can be used for purposes of providing a soft material for making contact with the baby.

Other aspects and advantages of the present invention will become apparent from the following description of the preferred embodiment, taken in conjunction with the accompanying drawings which illustrate by way of example, the principles of the invention.

BRIEF DESCRIPTION OF THE DRAWINGS

FIG. 1 is a side elevational view of the invention in an assembled and extended condition adjacent to a bed with accessories drawn in phantom line;

FIG. 2 is a top plan view of a hinged embodiment of the invention with attachable means shown in phantom line under the first and second panels;

FIG. 3 is a side elevational view of the invention shown in FIG. 2;

FIG. 4 is a side elevational view or another embodiment of the invention showing horizontal supports screwedly affixed to the first and second horizontal panels;

FIG. 5 is a bottom plan view of the assembled invention as shown in FIG. 4 with the vertical wall and rails shown in phantom line;

FIG. 6 is a top plan view of the invention shown in FIGS. 4 and 5 with attachment components underneath shown in phantom line; and FIG. 7 is a fragmentary perspective view of the second horizontal panel means receiving a horizontal support.

DESCRIPTION OF THE PREFERRED EMBODIMENTS

As shown in the drawings the invention is embodied in a baby crib 9 adjacent a standard bed 11 comprising a mattress 13, a box spring 15 and box spring support or bed frame 17. The baby crib 9 comprises a first horizontal panel 19 attached or in association with a second horizontal panel 21 which when in an assembled condition, both lie in the same horizontal plane. The first horizontal panel 19 has rounded corners on two sides which may be symmetrical or asymmetrical as shown in FIG. 2.

Supported upon the first horizontal panel is a peripherally curved vertical wall 22 which encircles approximately three out of four sides of the first horizontal panel 19. Ideally the vertical wall 22 is planar and a quarter inch thick or less so as to bend and fit within a slotted channel (not shown) or between two rails 20 associated with the first horizontal panel. Screws 28 or pegs can fasten the vertical wall 22 within the rails 20.

A lower portion of the wall 24 can be positioned so it is facing the foot of the bed 11 while a higher portion 25 of the wall 22 can be ideally positioned toward the head (not shown) of the bed 11. The wall 22 need not necessarily be curved, as shown nor the top of the wall generally tapering as shown. Also, both portions 24 and 25 may be generally lower than the rest of the vertical wall 22.

Within the confines of the vertical wall 22 and positioned upon the first horizontal panel 19, a baby pad 27 can be utilized upon which can rest a baby mattress 29. Optimumly the height of the baby pad 27 and baby mattress 29 should be of a combined height so that the surface 31 of the baby mattress 29 lies generally in the same plane as a surface 33 of the mattress 13.

Between the first and second horizontal panels 19 and 21 can be a long hinge 35 for attachment, although other means of attachment may be used. Also, at least one horizontal support 37 can be utilized to connect the first and second horizontal panels 19 and 21 to provide additional support to the extended first horizontal panel 19. If horizontal supports 37 are used and secured to both horizontal panels 19 and 21, then another attachment such as the hinge 35 may not be necessary. The horizontal support 37 can be flat metal bar stock or a round aluminum pole.

A vertical support 39 can be utilized to provide attachment to an undersurface 41 of the first horizontal panel 19 or the horizontal support 37. The vertical support 39 can have a variable length by way of a further extending leg 43 having a foot 45 for engagement with a floor 47. The vertical support 39 can have an attachable base 49 which screwedly fastens to the first horizontal panel 19 or the horizontal support 37. FIGS. 5 and 6 show two vertical supports 39 while it should be understood that a single vertical support 39 may be used so long as a perpendicular cross-ban support (not shown) sufficiently receives the load of the crib and transfers it to the single vertical support 39.

Various accessories can be used which are clipped or are fastened to the vertical wall 22. Such accessories include a night light 51 which has a clip 53 for attachment to the vertical wall 22, so as to clip onto the outside of the crib 9 and out of reach from any baby. Similarly, an exterior shelf 55 or rack can be utilized having an overhanging clip 57 including a horizontal member 59 for purposes of putting baby accessories (not shown) such as baby powder, baby bottles, and other various accessories (not shown) or handling towels, diapers, etc. Numerous other retaining receptacles (not shown) can also be used. Also, a music box (not shown) or a tape player (not shown) can be attachable to the vertical wall 22 by various means.

It should be pointed out that these items can be integrally formed with the vertical wall 22. However, for modularity and flexibility these items are not formed integrally with the vertical wall 22 in the preferred embodiments. Also, a basket 61 can be hung on the vertical wall 22 by way of a clip 63. It should be noted that in FIG. 1, portions of these accessories 55, 51, 61 and 63 are partially shown in phantom line.

As shown in FIG. 2, a plurality of shorter hinges 67 can be utilized with the long hinge 35. By having a combination of the long hinge 35, and the shorter hinges 67, a gap between the hinges is created for purposes of allowing the horizontal supports 37 to be attachable to the first and second horizontal panel means 19 and 21 by way of screwedly affixed attachment loops 71 shown in phantom line or screwedly fastened to the undersurfaces 41 and 73 of first and second horizontal panel means 19 and 21. This configuration allows the horizontal supports 37 to be positioned generally perpendicular to the axis of symmetry of the hinges 67 and 69. Furthermore, the horizontal supports 37 may lie generally in the same horizontal plane as the hinges 67 and 69. However, the horizontal supports 37 will generally lie adjacent to the undersurface 41 of the first horizontal panel 19 and the undersurface 73 of the second horizontal panel 21. The resulting configuration achieves a rigid construction with a generally smooth and uninterrupted planar area 75 extending over both horizontal panels 19 and 21.

As shown in FIG. 3, the attachment loops 71 and the hinges 35 and 67 lie generally in the same plane under the first and second horizontal panel means 19 and 21. Furthermore, with the exception of the vertical wall 22, the extending planar area 75 can be more clearly seen.

The curved vertical wall 22 does not extend entirely around the first horizontal panel 19. However, the curved vertical wall 22 which may be formed out of a transparent or opaque polymeric material having generally two sides 79 and 81 generally the same height. A third side 83 generally tapers in a convexly sloping manner and then transitions to a generally concavely rounded downwardly manner.

The third side 83 is preferably positioned toward the foot of the bed 11 for greater access to the baby when putting the baby into the crib 9 or taking the baby out of the crib 9. However, all sides 79, 81, and 83 may be of equal or different heights. The curved vertical wall 22 can be ideally made out of an acrylic, polycarbonate, or any other transparent and durable material, as can be flexible and planar prior to attachment.

It should be also noted that the curved vertical wall 22 is configured such that a portion 85 of the first horizontal plane 19 can be freely insertable between a mattress 13 and box spring 15. This allows for greater stability between the crib 9 and the bed 11.

The vertical wall is shown screwedly affixed to the rails 20 of the first horizontal panel 19 by screws 28. However, easily removable pins (not shown) may also be used. Also, instead of rails, a slotted channel may be used with predrilled horizontal holes (not shown) in the first horizontal panel for receiving engaging screws or pins (not shown).

However, the curved vertical wall 21 can be adhesively bonded, glued, or ultrasonically welded, or otherwise screwedly affixed to the first horizontal panel 19. The curved vertical wall 22 can be adhesively glued using an adhesive generally known in the art for the particular polymeric materials chosen. However, it should be noted that the adhesive glue used should be compatible with both the material of the curved vertical wall 22 and the selected material for the first horizontal panel 19.

As particularly shown in FIG. 4, the long hinge 35 or the smaller hinges 67 are not necessary where a horizontal support 37 is screwedly fixed or attached by the attachment loops 71 to the first and second horizontal panels 19 and 21. It is important that the horizontal support 37 extends a substantial length of both the undersurface 41 of the first horizontal panel 19 and the undersurface 73 of the second horizontal panel 21. It is also important that both horizontal panels means 19 and 21 lie in the same plane when the horizontal support or supports 37 are attached thereto.

In this preferred embodiment, a plurality of holes 87 along a length of both horizontal panel means 19 and 21 match correspond to holes 87 along the length of the horizontal support 37. Bolts 89 thread through the holes 87 to engage bolts 91. It is preferable that the length of the bolts 89 are such that the bolts 89 can engage the nuts 91 and tighten so that the bolts will not extend beyond the nuts 91. Also, it may be preferable to reverse the positioning of the bolts 89 relative to the nuts 91, thereby providing an uninterrupted planar surface 75, uninterrupted by the nuts 91, whereas the bolts 89 may recess within the holes 87.

Also, as shown in FIG. 4, the vertical support 39 is screwedly affixed by way of bolts 89 to the undersurface 91 of the horizontal support 37. The bolts 89 attached to both the horizontal supports 37 and the undersurface 41 of the first horizontal panel 19. This configuration can be more clearly seen in FIG. 5.

As shown in FIG. 4, the vertical support 39 has a variable length which is achieved by the extending leg 43 which is threaded screwing inwardly or outwardly to the attachment base 49 having mating threads, although other types of variable adjustable length mechanisms can be used.

As shown in FIG. 5, the hinge 35, the horizontal supports 37 and the vertical supports 39 are all attached to the undersurface 73 of the second horizontal panel 21 or the first horizontal panel 19. The vertical wall 22 is shown in phantom line and can only be seen if the first horizontal panel 19 were transparent in this view. By positioning all these components under the crib 9, the crib offers a planar surface 75 on which to slide between a mattress 13 and a box spring 15 as well as to receive a baby mattress 29.

FIG. 6 shows the planar surface 75 with only slight interruption resulting from the positioning of the nuts 91 which can be remedied by reversing the nuts 91 with the bolts 89.

FIG. 6 shows the uninterrupted planar surface 75, wherein only the nuts 91 are exposed. However, as previously stated the bolts 89 can be reversed with the nuts 91, wherein the bolts 89 recess within the holes 87 of the first and second horizontal panels 19 and 21 to provide the uninterrupted planar surface 75.

FIG. 6 shows the horizontal supports 37 and vertical supports 39. As shown in the drawing, the vertical wall 22 is curved and does not have any sharp corners, and does not extend entirely around the periphery of the first horizontal panel 19. Gaps 95 in the vertical wall 22 allow a portion of the first horizontal panel 19 to slide between the mattress 13 and box spring 15 as shown in FIG. 1.

The horizontal supports 37, vertical supports 39, and hinge 35 are shown in phantom since they would not be visible in this view unless both the first and second horizontal panels 19 and 21 were made of a transparent material.

As shown in FIG. 7, attachment loops 71 can be utilized in association with the horizontal supports 37. The attachment loops 71 can be screwedly affixed or mounted to the first horizontal panel as shown in FIG. 7, and also screwedly attached to the second horizontal panel 21 (not shown). For FIG. 7, it is assumed that the first horizontal panel 19 is constructed of a transparent plastic material wherein the attachment loops 71 and a portion of the horizontal supports 37 can be clearly seen.

For purposes of assembly, the horizontal supports 37 are slid through the attachment loops 71 located on both first and second horizontal panels 19 and 21. By utilizing such attachment loops 71 instead of the bolts 89, holes 87, and nuts 91, the crib 9 is more readily and easily assembled and disassembled. Also, the hinges 35 and 67 may not be necessary.

For disassembly, the horizontal supports 37 can be removed from the attachment loops 71 so that the first and second horizontal panels 19 and 21 can be hingedly rotated or stacked onto each other so their undersurfaces 41 and 73 are adjacent each other. Furthermore, the vertical wall 22 can be constructed of a rigid planar material for attachment along the rounded periphery of the first horizontal panel 19. The materials selected for utilization in the second horizontal panel 21 can be of such type that retains its original planar shape when detached from the first horizontal panel 19. When the horizontal and vertical supports 37 and 39, respectively, are removable from the first and second horizontal panels 19 and 21, and the vertical wall 22 is removable, then the entire crib 9 can be easily transported and stored as packable planar sections which can be easily placed up against a wall or placed in packing boxes (not shown).

In the preferable embodiment, the vertical supports 39 and horizontal supports 37 can be made of aluminum, steel, plastic or any other type of durable materials well known to the person ordinarily skilled in the bedding art. Furthermore, the vertical wall 22, and first and second horizontal panels 19 and 21 can be comprised of metal wood, or preferably a transparent or opaque polymeric material. One such materials is acrylic known as plexiglass. Also, other polymeric materials such as polycarbonate and those related transparent and durable plastics known to persons skilled in the art can be utilized in the present invention.

The hinge 35 and hinges 67, attachment means 97, nuts 91 and bolts 89 are ideally made of a metal material, however a person ordinarily skilled in the art can see that other types of materials, such as a polymeric replacement compositions can be utilized.

It should be appreciated from the foregoing description that the present invention provides an improved bedside crib, which is simply constructed and completely effective in providing a place next to a parent's bed for retaining a new born child and early bonding. The crib is a convenient, transportable, and storable baby crib which allows for ease of access to the baby, and yet allows the baby to easily see out of the crib. The crib can be easily assembled from a minimum number of separate components, and can be manufactured with relatively inexact precision, and all are configured to facilitate compact and efficient shipment.

Although the present invention has been described in detail with reference only to the presently preferred embodiments, it will be appreciated by those of ordinarily skilled in the art that various modifications can be made departing from the invention. Accordingly, the invention is limited only by the following claims.

We claim:

1. A baby crib or the like in association with a mattress or a bed, comprising:

(a) a first horizontal panel means for supporting a crib mattress or the like;

(b) a vertical wall means for partially encircling said first horizontal panel means, and attachable to said first horizontal panel means; and (c) a second horizontal panel means for supporting said first horizontal panel means, wherein said second horizontal panel means is adapted to attach to said first horizontal panel means, said horizontal panels being attached in an extended condition, and said second horizontal panel means positionable under the mattress, whereby said second horizontal panel means supports said first horizontal panel means and said vertical wall means in said extended condition adjacent the bed, and wherein said first and second horizontal panel means having at least one attachment means for attaching to each of said first and second panel means, and further comprising at least one horizontal support attachable to said attachment means, thereby providing secure attachment between said first and second horizontal panel means providing greater support to said first horizontal panel means in said extended condition.

2. A baby crib or the like as claimed in claim 1, wherein said vertical wall means is removable with respect to said first horizontal panel means so as to provide for a more compact baby crib for storage or transportation in a disassembled condition.

3. A baby crib or the like as claimed in claim 1, further comprising at least one vertical support attachable to an undersurface of said first horizontal panel means so as to support said first horizontal panel means and said vertical wall means in said extended condition, whereby said vertical support is of a length sufficient to extend between said extending first horizontal panel means and a floor supporting the bed.

4. A baby crib or the like as claimed in claim 1, wherein said vertical wall means has a varying height along its length, thereby allowing a greater ease of access to the crib from a lower section of said vertical wall.

5. A baby crib or the like as claimed in claim 1, wherein said vertical wall is formed by a material which is transparent, thereby allowing a baby to see out of the crib or a parent to see into the crib more readily.

6. A baby crib or the like as claimed in claim 1, wherein said first horizontal panel means is attached to said second horizontal panel means by way of a hinge, thereby allowing said first horizontal panel means to rotate relative to said second horizontal panel means, and allowing said first and second horizontal panel means to be folded over onto each other for compactness.

7. A baby crib or the like as claimed in claim 1, further comprising a clip-on accessory holder means for holding various baby accessories, wherein said accessory holding means comprises an attachment means perpendicularly attached to a horizontal support section which lies generally parallel to said first horizontal panel means.

8. A baby crib or the like as claimed in claim 1, further comprising a night light having a clip so as to clip onto said vertical wall means, thereby selectively illuminating the baby crib.

9. A baby crib or the like as claimed in claim 1, further comprising a mattress of a shape and size so as to fit within said vertical wall means and upon said first horizontal panel means.

10. A baby crib or the like readily attachable to a bed having a mattress comprising a first horizontal board adapted to receive a vertical wall member which encircles substantially three sides of said horizontal board for retaining a baby mattress thereon, further comprising a second horizontal board attachable to said first horizontal board, wherein portions of said second horizontal board can slide under the mattress for supporting the baby crib adjacent the bed, and further comprising a vertical support of variable length which supports said first horizontal board, and wherein said first and second horizontal boards are movable with respect to each other in an unassembled condition, and further comprising a horizontal support attachable to each of said first and second horizontal boards, thereby sharing load between said boards.

11. A baby crib as claimed in claim 10, wherein said first and second horizontal boards are connected therebetween by a hinge, and wherein said horizontal support is screwedly fastened to said first and second horizontal boards in an assembled condition, and wherein said vertical support screwedly attached to an undersurface of said first horizontal board.

12. A baby crib as claimed in claim 10, wherein said vertical wall member is made of a transparent polymeric material, and wherein said first and second horizontal boards are made out of a polymer material which is readily attachable to said vertical wall member.

13. A baby crib as claimed in claim 10, further comprising a baby accessories' holder which can be selectively attached to said vertical wall member to make available various baby accessories held by said holder in close association with the baby crib.

14. A baby crib or the like in association with a mattress or a bed, comprising:

(a) a first horizontal panel means for supporting a crib mattress or the like;

(b) a vertical wall means for partially encircling said first horizontal panel means, and attachable to said first horizontal panel means; and (c) a second horizontal panel means for supporting said first horizontal panel means, wherein said second horizontal panel means is adapted to attach to said first horizontal means, said horizontal panel means being attached in an extended condition, and said second horizontal panel means positionable under the mattress, whereby said second horizontal panel means supports said first horizontal panel means and said vertical wall means in said extended condition adjacent the bed, and wherein said first horizontal panel means is attached to said second horizontal panel means by way of a hinge, thereby allowing said first horizontal panel means to rotate relative to said second horizontal panel means, and allowing said first and second horizontal panel means to be folded over onto each other for compactness, and wherein said hinge is interrupted, and further comprising at least one horizontal support means attachable between said first and second horizontal panel means, wherein said horizontal support means is attachable to each of said first and second horizontal panel means and having an axis of symmetry substantially perpendicular to an access of symmetry of said hinge, and wherein said horizontal support means and said hinge generally lie in the same horizontal plane.

* * * * *